United States Patent [19]

Karashima

[11] 3,981,552

[45] Sept. 21, 1976

[54] SHOWCASE

[76] Inventor: Masashi Karashima, 40-7, Sangenjaya 2-chome, Setagaya, Tokyo, Japan

[22] Filed: May 20, 1975

[21] Appl. No.: 579,324

[30] Foreign Application Priority Data

Oct. 30, 1974 Japan ..... 49-124310

[52] U.S. Cl. ..... 312/250; 312/126; 312/313; 211/162

[51] Int. Cl.[2] ..... A47B 77/10; A47F 5/00

[58] Field of Search ..... 312/313, 314, 327, 250, 312/126; 211/162

[56] References Cited

UNITED STATES PATENTS

| | | | |
|---|---|---|---|
| 1,335,415 | 3/1920 | Adams | 312/313 |
| 2,679,444 | 5/1954 | Bennett | 312/327 |
| 2,903,318 | 9/1959 | Brockway | 312/313 |
| 3,063,773 | 11/1962 | Rosenquist et al. | 312/313 |
| 3,150,902 | 9/1964 | Naab et al. | 312/250 |
| 3,172,376 | 3/1965 | Havlis | 108/59 |
| 3,240,507 | 3/1966 | Braun | 280/79.3 |
| 3,259,443 | 7/1966 | Lavigne et al. | 312/126 |
| 3,403,789 | 10/1968 | Morte et al. | 211/162 |

*Primary Examiner*—Paul R. Gilliam
*Assistant Examiner*—Victor N. Sakran
*Attorney, Agent, or Firm*—Wenderoth, Lind & Ponack

[57] ABSTRACT

A multi-shelf type of showcase comprises a number of shelf plate supported substantially in a horizontal position at different levels. A shelf plate at each shelf level consists of a rear shelf section carried by shelf supports on the left and right sides of the showcase, and a movable front shelf section fitted in said rear shelf section slidably in the forth and back directions. The movable front shelf section can be drawn out forwardly of said rear shelf section upon using the same, while it can be inserted and accommodated within said rear shelf section when it is not in use. According to one aspect of the present invention, the respective rear shelf sections are fixedly secured to a framework of the showcase. However, according to another aspect of the invention, each of said rear shelf sections is pivotably mounted on a framework of the showcase so as to be rotatable upwardly about an axis at the rear end portion thereof. The front shelf section is provided with a latch protrusion at its front end portion, while on the bottom surface of the rear end portion of said rear shelf section and on the bottom surface of the rear end portion of a top wall of said showcase are respectively provided latch receiver means adapted to be engaged with said latch protrusions of said respective front shelf sections when each said front shelf section is accommodated in the associated rear shelf section and rotated upwardly about said axis jointly with said rear shelf section. In this mode of embodiment, when both the front and rear shelf sections become unused, said rear shelf section having said front shelf section accommodated therein can be rotated upwardly about said axis and locked at a substantially vertical position by engagement between the latch protrusion and the latch receiver means.

3 Claims, 9 Drawing Figures

SHOWCASE

Figure 2:
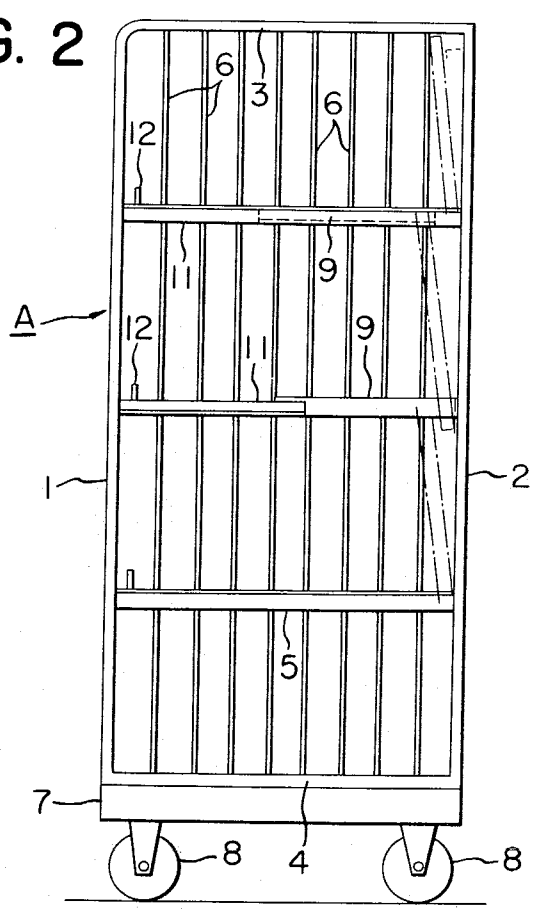

The present invention relates to a showcase, and more particularly, to improvements in a multi-shelf type of showcase.

In general, in a multi-shelf type of showcase for the display and sale of some kinds of goods, the good are sold successively from a front portion to a rear portion of the uppermost shelf plate and then similarly on the second shelf plate, and so on. However, heretofore, in such a showcase, there was a shortcoming that an upper vacant shelf plate or plates would hinder a customer from looking at goods on the lower shelf plate. The present invention has been worked out to eliminate the shortcoming of the showcase in the prior art.

Therefore, it is a principal object of the present invention to provide an improved showcase in which, even after the goods on the upper shelf plate have been sold, a customer can easily look at the goods on the next lower shelf plate, and the display and sale of those goods is enhanced.

In order to achieve the aforementioned object, according to one feature of the present invention, a multi-shelf type of showcase is provided in which a shelf plate at each shelf level consists of a rear shelf section carried by shelf supports on the left and right sides of the showcase and a movable shelf section fitted in said rear shelf section which is slidable back and forth.

Because of the above-featured construction of the improved showcase, when the goods on the movable front shelf section of an upper shelf plate have been sold, if the movable front shelf section that is vacant is slided and retracted back so as to be inserted and accommodated within the rear shelf section, then the front half of the upper shelf plate is cleared, thereby enabling customer to look at the goods on the next lower shelf plate through the cleared portion of the upper shelf plate. Therefore, this improved showcase is convenient for customers and can enhance the display and sale of goods.

According to another feature of the present invention, a multi-shelf type of showcase is provided in which a shelf plate at each shelf level consists of a rear shelf section carried by shelf supports on the left and right sides of the showcase, so as to be rotatable upwardly about an axis at a rear end portion thereof and a front shelf section fitted in said rear shelf section which is slidable back and forth. Said front shelf section is provided with a latch protrusion at its front end portion, and on the bottom surface of the rear end portion of a top wall of said showcase are respectively provided latch receiver means adapted engage said latch protrusions of said respective front shelf sections when each said front shelf section is accommodated in the associated rear shelf section and rotated upwardly about said axis jointly with said rear shelf section.

Because of the above-featured construction of the further improved showcase, initially the rear shelf section is held at a horizontal position and the front shelf section is drawn out forwardly from the rear shelf section when both the front and rear shelf sections are in use for displaying goods, but when only the front shelf section of an upper shelf plate becomes unused as the goods thereon have been sold out, if the front shelf section is inserted and accommodated within the rear shelf section held at its horizontal position, then the front half of the upper shelf plate is cleared to enable a customer to well look at the goods on the next lower shelf plate through the cleared portion of the upper shelf plate. Still further, when both the front and rear shelf sections of the upper shelf plate are cleared as all the goods thereon are sold, if the rear shelf section having the front shelf section accommodated therein is rotated upwardly about the axis until said latch protrusion at the front end portion of said front shelf section is engaged with said latch receiver means on the bottom surface of the rear shelf section of the next above shelf plate or on the bottom surface of the top wall of the showcase, then the whole area of the upper shelf plate is cleared to enable a customer better look at the goods on the next lower shelf plate without hindrance. Therefore, this further improved showcase is more convenient for customers, and thus it can further enhance the display and sale of goods.

Figure 1:
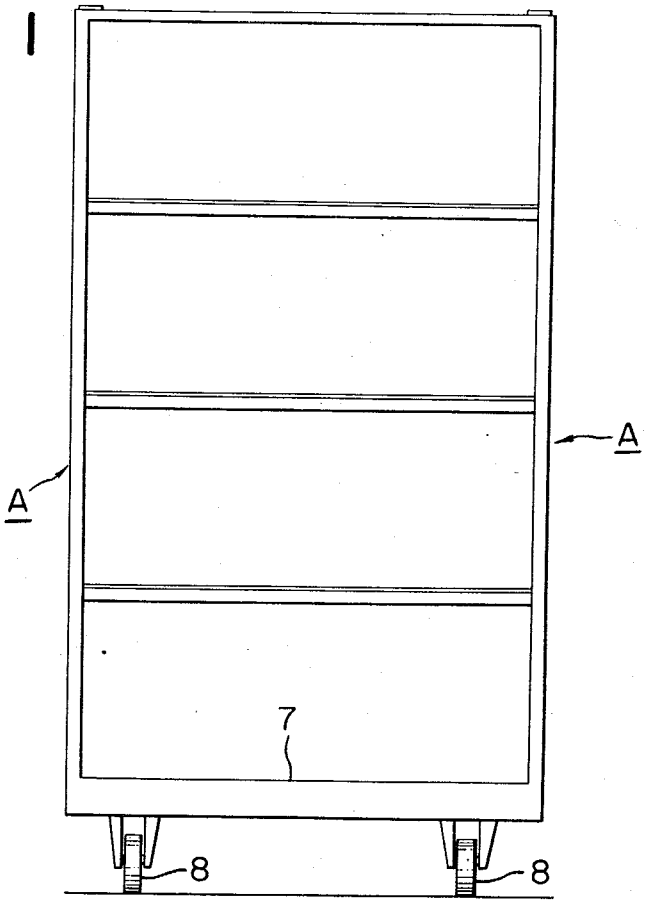
Figure 3:
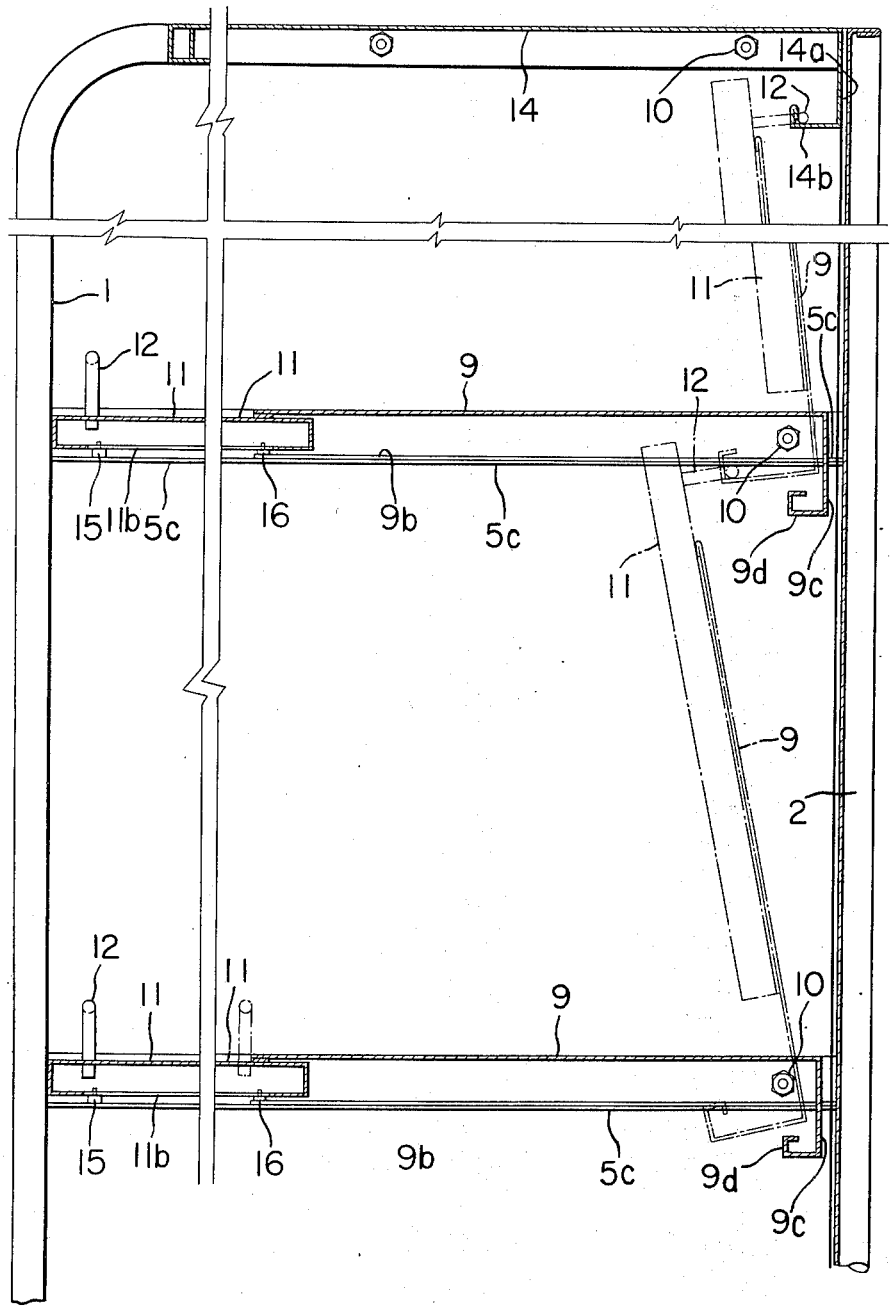
Figure 4:
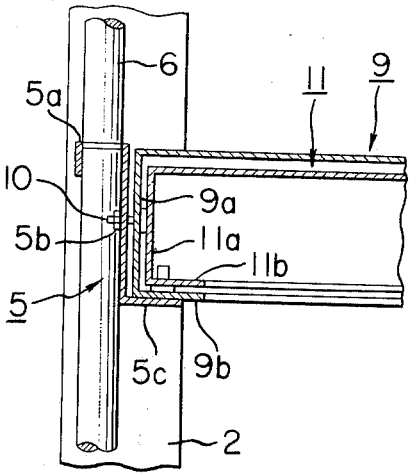
Figure 7:
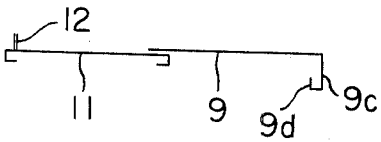
Figure 9:
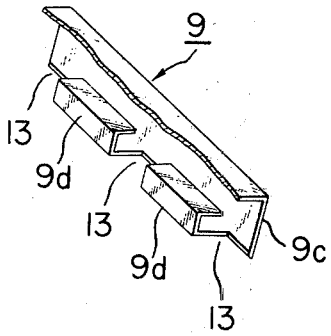
Figure 5:
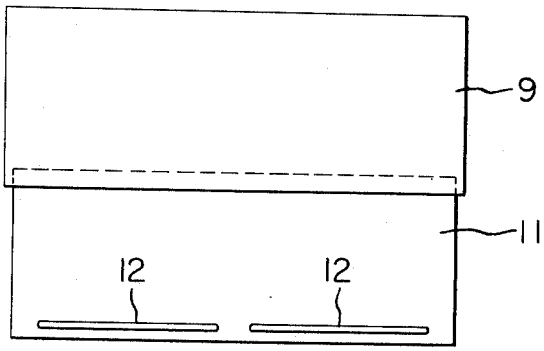
Figure 6:
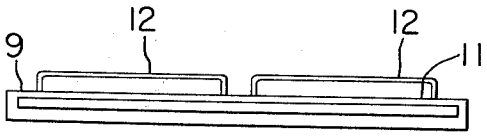
Figure 8:
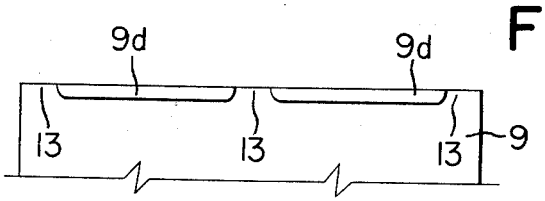

The above mentioned and other objects, features and advantages of this invention will become more apparent by reference to the following description taken in conjunction with the accompanying drawings, in which:

FIG. 1 is a front view showing one preferred embodiment of a showcase according to the present invention, FIG. 2 is a side view of the same, FIG. 3 is an enlarged longitudinal cross-section side view partly cut away of an essential portion of the same, FIG. 4 is an enlarged longitudinal cross-section front view of an essential portion of the same, FIG. 5 is a partial plan view showing the positioned relationship between each front shelf section and its associated rear shelf section, FIG. 6 is a front view of the front and rear shelf sections shown in FIG. 5, FIG. 7 is a schematic longitudinal cross-section view of the front and rear shelf sections shown in FIGS. 5 and 6, FIG. 8 is a bottom view of a rear end portion of the rear shelf section, and FIG. 9 is an enlarged perspective view of the rear end portion of the rear shelf section shown in FIG. 8.

Now the present invention will be described in more detail with reference to the preferred embodiment shown in the accompanying drawings.

In the drawings, reference character (A) designates left and right side frameworks, each of which consists of a front column 1 and a rear column 2 each made of a square pipe and upper and lower lateral frames 3 and 4. Between the front and rear columns 1 and 2 of each side framework (A) a desired number of shelf supports 5 are bridged, and a number of vertical rods 6 (See FIGS. 2 and 4) disposed at desired intervals between the upper and lower lateral frames 3 and 4 penetrate through upper horizontal pieces **5*a* (See FIG. 4) of the shelf supports 5. In FIGS. 1 and 2, a base frame 7 supports the side frameworks (A), and rollers 8 are mounted at the bottom of the base frame 7**.

A has rear shelf section 9 having a shallow channel-shaped cross-section, has vertical pieces **9*a* on the opposite sides which are rotatably mounted at their rear end portions to vertical pieces 5*b* of the left and right shelf supports 5, respectively, via pivot bolts 10 and hase lower horizontal pieces 9*b* on the opposite sides extending from the lower edges of the vertical pieces 9*a* are adapted to ride on lower horizontal pieces 5*c* of the left and right shelf supports 5, respectively, when the rear shelf section 9** occupies its horizontal position.

A front shelf section 11 having a shallow channel-shaped cross-section, is slidably fitted in the rear shelf section 9. As best seen in FIGS. 3 and 4, lower horizontal pieces 11*b* extending from lower edges of left and right side vertical pieces 11*a* of the front shelf section 11 are supported on the lower horizontal pieces 9*b* of the rear shelf section 9 and on the lower horizontal pieces 5*c* of the left and right shelf supports 5, respectively, via sliders 15 and 16 having appropriate thickness and fixedly secured to the front shelf section 11 so as to be slidable backward and forward along the lower horizontal pieces 5*c* of the shelf supports 5.

On the top surface of the front end portion of the front shelf section 11 a pair of gate-shaped latch protrusions 12, are vertically while an L-shaped piece 9*d* extending from a lower edge of a rear vertical piece 9*c* which hangs from a rear edge of the rear shelf section 9, is notched with latch receiver recesses 13 adapted to be engaged with the latch protrusions 12 on the front shelf section when the front and rear shelf sections are retracted backwardly as fully described later.

In addition, an L-shaped piece 14*b* extending from a lower edge of a rear vertical piece 14*a*, which hangs from a rear edge of a top all 14 of the showcase, is also notched with latch receiver recesses (not shown) adapted to be engaged with the latch protrusions 12 on the front shelf section like the latch receiver recesses 13 of the rear shelf section 9.

Since the showcase according to the present invention is constructed as described above, initially at each shelf level the rear shelf sectin 9 is rotated about the pivot 10 to its horizontal position, where the lower horizontal pieces 9*b* on the opposite sides of the rear shelf section 9 are supported by the lower horizontal pieces of the shelf supports 5. Thereafter the front shelf secton 11 which has been accommodated within the rear shelf section 9 is drawn out forwardly from the rear shelf section 9 by sliding the lower horizontal pieces 11*b* of the front shelf section 11 via the sliders 15 and 16, as guided by the lower horizontal pieces 9*b* of the rear shelf section 9 and the lower horizontal pieces 5*c* of the shelf supports 5, respectively, until the front edge of the front shelf section 11 collides against the front columns 1 of the left and right side frameworks (A). After all the shelf plates have been extended horizontally in the above-described manner, goods are arranged on both the front and rear shelf sections 11 and 9 of the respective shelf plates for the purposes of display and sale.

When the goods on the front shelf section 11 of the upper shelf plate have been sold, the front shelf section 11 is retracted so as to be inserted and accommodated within the associated rear shelf section 9. Then, the front half of the upper shelf plate is cleared to enable a customer to well look at the goods on the next lower shelf plate through the cleared portion of the upper shelf plate. Still further, when the goods on the same rear shelf section 9 have also been sold, the rear shelf section 9 having the front shelf section 11 accommodated therein is rotated upwardly about the pivot 10 while drawing out the front shelf section 11 a little from the rear shelf section 9. Thereafter, the front shelf section 11 is again fully inserted into the rear shelf section 9. The opposite side pieces of the gate-shaped latch protrusions 12 are then fitted in the latch receiver recesses 13 notched in the L-shaped piece 9*d* at the rear edge of the upper shelf section 9 or in the similar latch receiver recesses notched in the L-shaped piece 14*b* at the rear edge of the top wall 14, and thus the latch protrusions 12 are locked between the L-shaped piece 9*d* of the upper rear shelf section 9 and its rear vertical piece 9*c* or between the L-shaped piece 14*b* of the top wall 14 and its rear vertical piece 14*a*. In this way both the front and rear shelf sections 9 and 11 are retracted to the rearmost position of the showcase in an erected state as shown by chain lines in FIG. 3, so that the whole area of the upper shelf plate is cleared to better enable a customer to look at the goods on the next lower shelf plate.

Subsequently, when the front shelf section of the next lower shelf plate becomes vacant, and when the rear shelf section of the next lower shelf plate also becomes vacant, the aforementioned operations for retracting the front and rear shelf shelf sections to the rearmost position of the showcase are similarly repeated, and as the successive shelf plates become vacant sequentially from top to bottom, the same operations are repeated. Thus, the improved showcase according to the present invention is very convenient for customers and can enhance the display and sale of goods.

Since many changes could be made in the above construction and many apparently widely different embodiments of this invention could be made without departing from the scope thereof, it is intended that all matter contained in the above description or shown in the accompanying drawings shall be interpreted as illustrative and not as limiting.

What is claimed is:

1. A multi-shelf showcase for displaying items, said showcase comprising:

an outside framework having front and back parallel vertical frame members;

a plurality of parallel, horizontal, vertically spaced shelf supports attached betwen said front and back frame members;

a plurality of shelving means pivotally attached between and resting upon each pair of parallel horizontal shelf supports within said framework for holding said items thereon, said shelving means being extensible, horizontally along said shelf supports and pivotable vertically upward;

latch means at the forward end of said shelving means for latching said pivotable shelving means in an upwardly vertical position;

first latch receiving means at the top inside rear portion of said framework for receiving and engaging said latch means of the uppermost shelving means when said uppermost shelving means is pivoted upward against said first latch means; and second latch receiving means integrally formed at the rearward end of each shelving means for receiving and engaging the latch means of the shelving means immediately therebelow when the uppermost of two vertically adjacent shelving means is pivoted upward and the lowermost shelving means of the two vertically adjacent shelving means is pivoted upward against said second latch receiving means formed at the rearward end of said uppermost shelving means.

2. A showcase as claimed in claim 1, wherein each shelving means is comprised of:

a rear shelf portion pivotally connected between a pair of said parallel horizontal shelf supports and resting thereon; and a front shelf portion slidably contained at the rearward end thereof within said rear shelf portion, slidably positioned against said pair of shelf supports at the forward end thereof, and abutting said front parallel frame members at the forward end thereof, whereby said front shelf portion is slidable within said rear shelf portion and said rear shelf portion with said front shelf portion slided therein is pivotable.

3. A showcase as claimed in claim 2, wherein:

said latch means is comprised of a pair of gate-shaped latch protrusions vertically upwardly disposed at the forward end of each front shelf portion;

said first latch receiving means is comprised of a first L-shaped member connected at the top rear inside edge of said frame work and extending downward therefrom, said L-shaped member having notched latch receiver recesses adapted to receive said gate-shaped latch protrusion at the forward end of the front shelf portion of the uppermost shelving means, whereby rotating the uppermost shelving means upperward with said front shelf portion slided partially within said rear shelf portion causes said gate-shaped latch protrusions on said front shelf portion of said uppermost shelving means to be received in said notched latch receiver recesses of said first L-shaped member, thereby latching the uppermost shelving means in the vertical position; and said second latch receiving means is comprised of a second L-shaped member integrally formed at the rear of each rear shelf portion and movable therewith, said second L-shaped member having notched latch receiver recesses adapted to receive said gate-shaped latch protrusions on said front shelf portion of the shelving means vertically adjacent therebelow, whereby when the uppermost of two adjacent shelving means is rotated upward, rotating the lower of two adjacent shelving means upward with said front shelf portion partially within said rear shelf portion causes said gate-shaped latch protrusions on said front shelf portion of said lower shelving means to be received in said notched latch receiver recesses of said second L-shaped member on the upper shelving means, thereby latching the lower shelving means in the vertical position to the upper shelving means.

* * * * *